US005093950A

United States Patent [19]

Heier

[11] Patent Number: 5,093,950

[45] Date of Patent: Mar. 10, 1992

[54] SELF PROPELLED VACUUM DRIVEN SWIMMING POOL CLEANER

[76] Inventor: William Heier, 715 N. Harvard Ave., Ventnor, N.J. 08406

[21] Appl. No.: 539,162

[22] Filed: Jun. 18, 1990

[51] Int. Cl.[5] ..... E04H 3/20

[52] U.S. Cl. ..... 15/1.7; 15/29; 15/387

[58] Field of Search ..... 15/1.7, 387, 29

[56] References Cited

U.S. PATENT DOCUMENTS

| | | | |
|---|---|---|---|
| 983,988 | 2/1911 | Foster et al. | 15/387 X |
| 2,609,555 | 9/1952 | Anderson | 15/387 X |
| 2,703,904 | 3/1955 | DeLong | 15/387 X |
| 2,967,314 | 1/1961 | Kowalewski | 15/49.1 X |
| 3,008,159 | 11/1961 | Del Vecchio | 15/387 X |
| 3,046,586 | 7/1962 | Allen et al. | 15/387 X |
| 3,122,765 | 3/1964 | Magarian | 15/387 X |
| 3,229,315 | 1/1966 | Watson | 15/387 X |
| 3,959,838 | 6/1976 | Hannah | 15/387 X |
| 4,679,270 | 7/1987 | Gaiti et al. | 15/29 |
| 4,734,954 | 4/1988 | Greskovics et al. | 15/1.7 |

*Primary Examiner*—Edward L. Roberts
*Attorney, Agent, or Firm*—Z. T. Wobensmith, III

[57] ABSTRACT

A self propelled vacuum driven swimming pool cleaner which has an outer cover or shroud which contains a vacuum driven motor connected to a reduction gear train, to rotate a brush assembly, that frictionally engages a surface to be cleaned, and propells the cleaner while scrubbing up and then vacuuming dirt and debris from the surface.

3 Claims, 4 Drawing Sheets

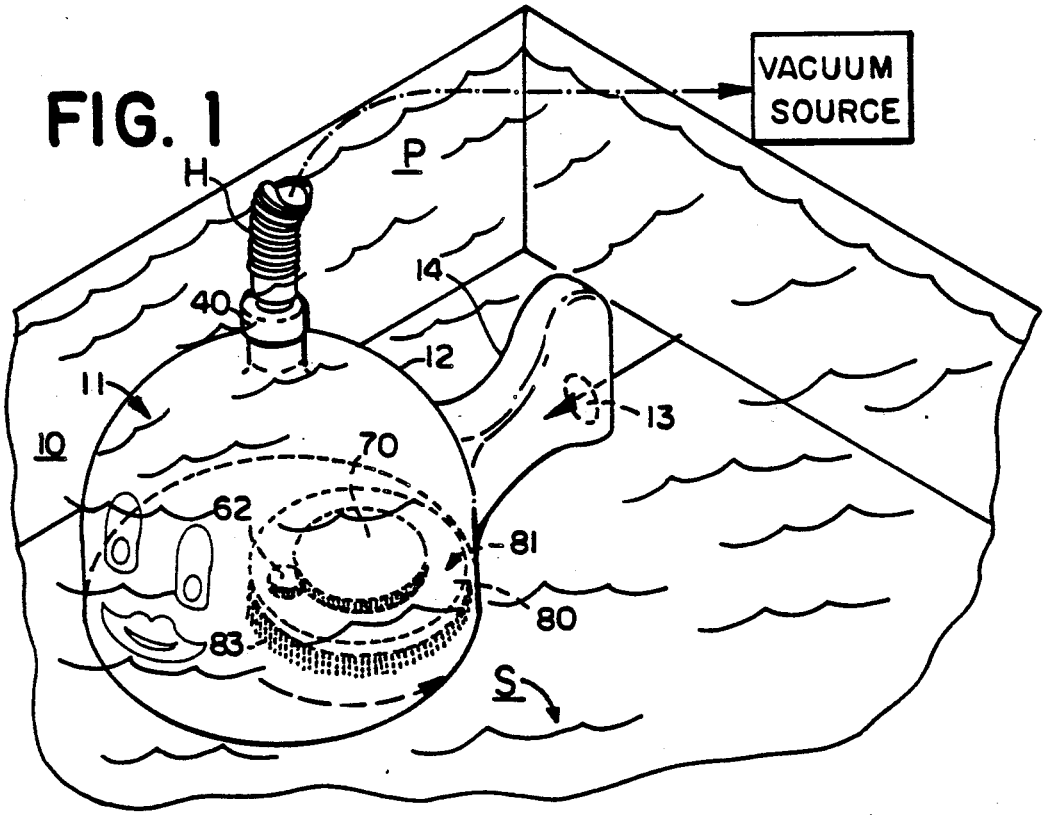
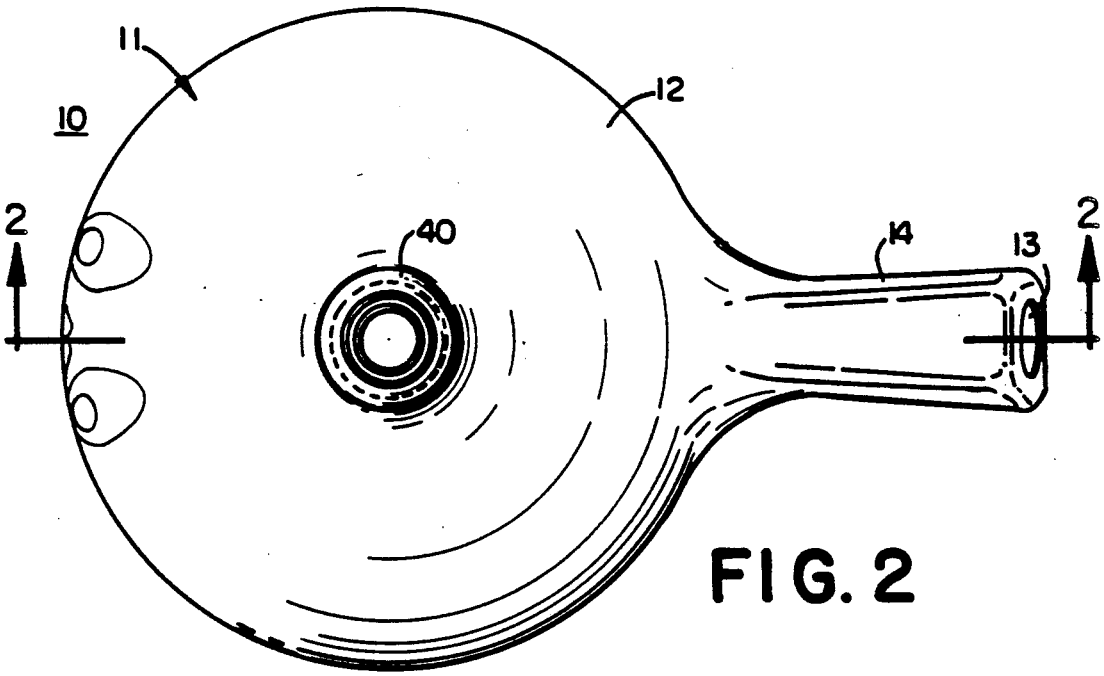
FIG. 2

SELF PROPELLED VACUUM DRIVEN SWIMMING POOL CLEANER

BACKGROUND OF THE INVENTION

1. Field of the Invention

This invention relates to a swimming pool cleaner of the submersible, vacuum motor, reduction gear driven brush assembly of the self propelled type.

2. Description of the Prior Art

The care and cleaning of swimming pools and spas occupies a great deal of time for owners and operators. It has long been recognized that a swimming pool cleaner that will automatically traverse the pool bottom surface while effectively picking up dirt and debris is desired. It has also been recognized that a cleaner that uses the existing pool water recirculation equipment, does not use electricity in its internal operation, and is of low cost, is desired. Many swimming pool cleaners have been proposed, examples of which are disclosed in the following U.S. patents:

| | |
|---|---|
| J. L. Gans | 634,813 |
| G. W. Del Vecchio | 3,008,159 |
| B. H. Watson | 3,229,315 |
| R. R. Myers | 3,321,787 |
| Foster | 3,790,979 |
| Raubenheimer | 3,803,658 |
| Henkin et al | 3,882,754 |
| Adamson et al | 3,849,823 |
| Hannah | 3,959,838 |
| Strausak | 3,979,788 |
| Hirata | 4,052,950 |
| Pansini | 4,100,641 |
| Pansini | 4,129,904 |
| Hofmann | 4,133,068 |
| Sommer | 4,154,680 |
| Bowler | 4,193,228 |
| Hofmann | 4,208,752 |
| Raubenheimer | 4,434,519 |
| Greskovics et al | 4,734,954 |

The prior art discloses many different variations of apparatus for cleaning swimming pools. Several wheeled type vehicles are disclosed, which may be propelled by a traction wheel such as disclosed in U.S. Pat. No. 3,790,979, which is also a suction device. U.S. Pat. No. 3,008,159 discloses a sweeper which includes a fluid operated turbine wheel which is directly coupled to a rotary brush, but this apparatus is not self-propelled and does not generate the required power to operate properly.

Devices which use electricity are not desirable due to the electric shock hazards. None of the prior art devices have been widely accepted by the consuming public, due to their limited cleaning action, high cost and/or lack of self propulsion. None of the prior art devices discloses apparatus which is vacuum or suction driven, that actually scrubs the pool surface, is self-propelled, of simple construction and low cost.

The structure of my cleaner meets the desired criteria and provides numerous advantages over the prior art.

SUMMARY OF THE INVENTION

This invention relates to a swimming pool cleaner which has an outer cover, is self-propelled, has an internally located vacuum driven motor connected to a reduction gear drive train which drives a rotatable brush assembly that scrubs the dirt and debris from the pool bottom, and also acts to propel the cleaner while sucking up the dirt and debris, which is then delivered through the pool's recirculation system to the existing pool filter.

The principal object of the invention is to provide a swimming pool cleaner that is self-propelled, vacuum operated, and which actually scrubs the dirt and debris from the pool surface and delivers it to the pool filter.

A further object of the invention is to provide a swimming pool cleaner that is simple and inexpensive to construct but sturdy and reliable in operation.

A further object of the invention is to provide a swimming pool cleaner of the character aforesaid which is easy to install and use.

A further object of the invention is to provide a swimming pool cleaner that uses the existing pool filter system.

A further object of the invention is to provide a swimming pool cleaner that is powerful and can be outfitted with a variety of different brush configurations.

DESCRIPTION OF THE DRAWINGS

The nature and charateristic features of the invention will be more readily understood from the following description taken in connection with the accompanying drawings forming part hereof in which:

FIG. 1 is a view in perspective, and in partial phantom, illustrating the swimming pool cleaner of the invention, in operation in a pool;

FIG. 2 is a top plan view, enlarged of the swimming pool cleaner of FIG. 1;

Figure 3:
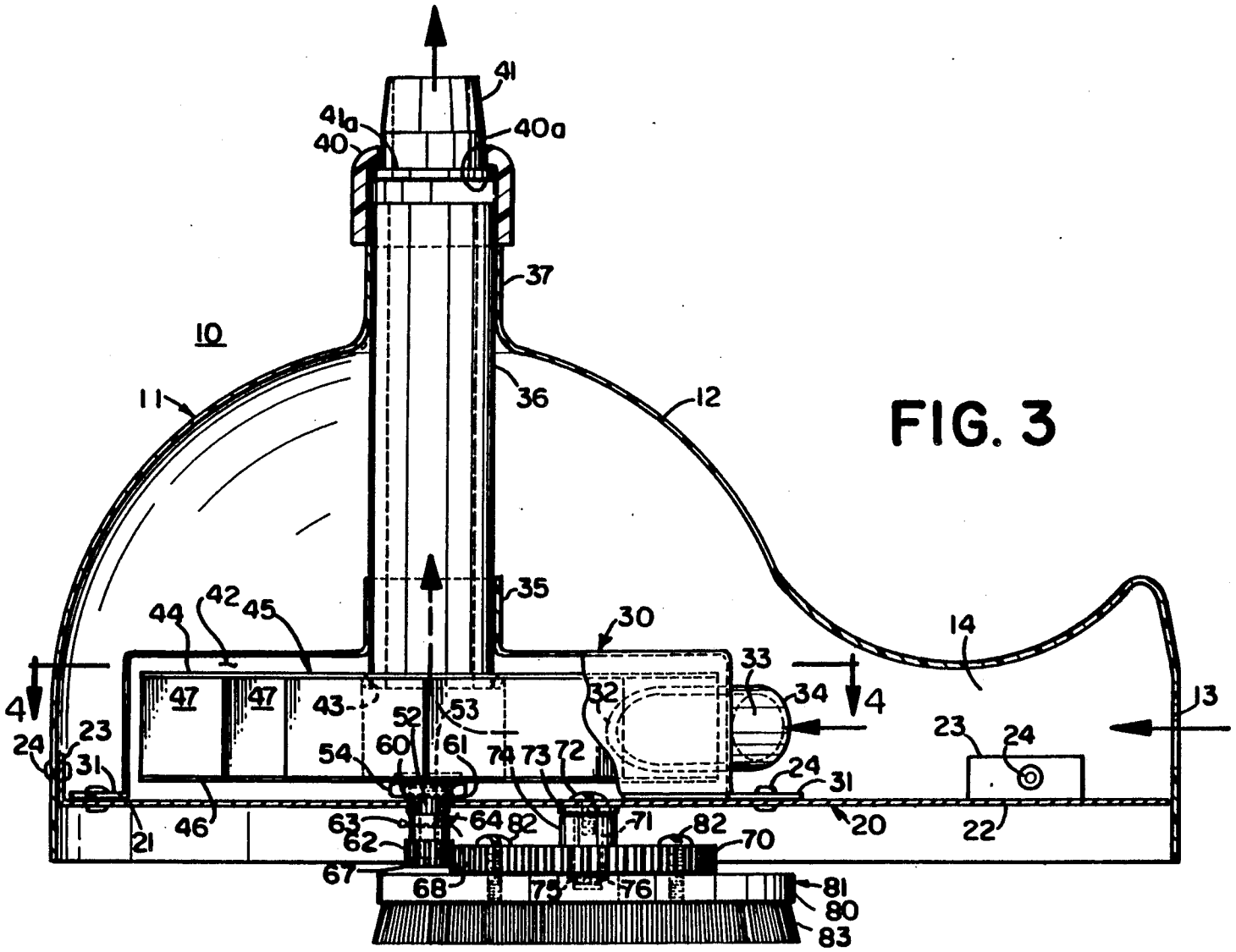
FIG. 3 is a vertical sectional view, further enlarged, taken approximately on the Line 3—3 of FIG. 2.
Figure 4:
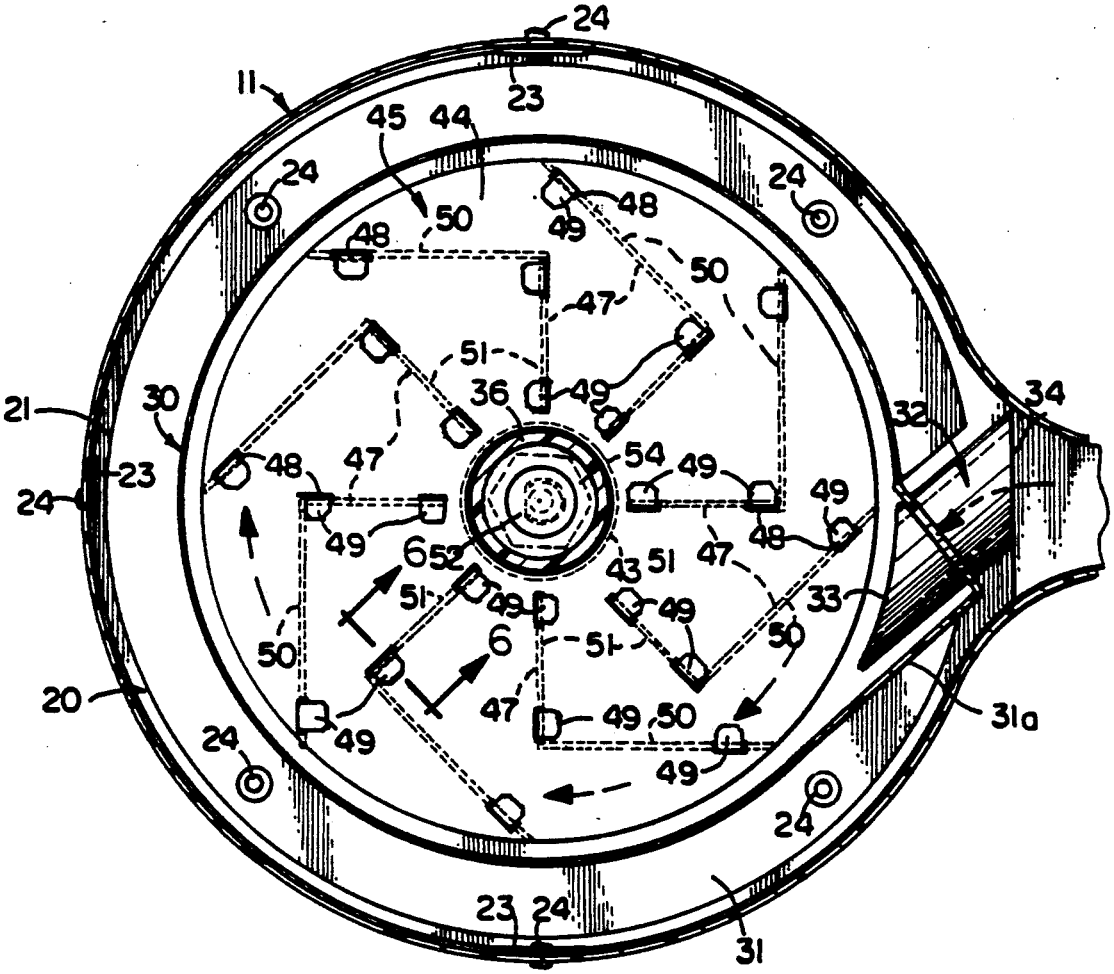
FIG. 4 is a horizontal sectional view taken approximately on the Line 4—4 of FIG. 3.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENTS

Referring now more particularly to the drawings and FIGS. 1–5A, and 6 inclusive, a swimming pool cleaner 10 is therein illustrated, in a corner of a pool P which has an inner surface S.

The cleaner 10 has an outer shroud or cover 11, which includes a main body 12, of bell shape, with a tail 14 of rectangular shape extending therefrom. The tail 14 may have a water inlet 13, to be described. The body 12 and tail 14 are integral and can be of any suitable molded plastic, acrylic buterate styrene being particularly suitable. Within the cover 11 a base plate 20 is provided, which can be of aluminum or other material which is rigid and is resistant to rust and corrosion. The plate 20 is of the same internal configuration as the cover 11 with a circular front portion 21, and a rear rectangular portion 22, which extends into the tail 14. The plate 20 can be positioned flush or recessed up into the cover whichthen acts as a shroud for improved performance and which improves the appearance of the cleaner.

The plate 20 is provided with a plurality of upwardly extending tabs 23, five being illustrated, which are attached to cover 11 by any well known fasteners, such as pop rivets 24.

Plate 20 can optionally be provided with one or a plurality of spaced water inlet slots 25, to be described.

A housing 30 is provided on front portion 21 of plate 20, which housing is of circular configuration, open at the bottom, and provided with a flange 31 which is fastened to plate 20 by well known fastners such as pop rivets 24.

The housing 30 is preferably of molded plastic or other suitable rust and corrosion resistant material.

The housing 30 has an extension 31*a*, which is an inlet, and with a pipe 32 therein, the centerline of which is tangential to the contour of the housing 30.

The pipe 32 has an inner edge 33 of the same curvature as the housing contour, and an external edge 34 which is perpendicular to the radius of the housing 30.

The housing 30 has an upwardly extending open neck 35, which has a pipe 36 therein, which extends upwardly through a neck 37 in the cover 11. The pipe 36 can be of polyvinylchloride or other suitable material, and is preferably glued to the necks 35 and 37.

The pipe 36 extends above neck 37 with a collar 40 of well known type thereon, which is preferably glued to pipe 36, has an inner rim 40*a*, and captures a shoulder 41*a* of a swivel fitting 41, of well known type. A hose H is attached to the fitting 41 and connected to a vacuum source VS which may be part of the pool's normal recirculation system (not shown).

The pipe 36 at the opposite end extends down into the interior 42 of housing 30 and through a downwardly extending collar 43, of a circular upper plate 44, of an impeller 45. The collar 43 acts as a bearing with pipe 36 to center the impeller 45, and permit rotation around pipe 36. The impeller 45 has a circular lower plate 46, and a plurality of vanes 47, which are fastened to both the top plate 44 and bottom plate 46 through slots 48, with bent down tabs 49, retaining the plates 46, 44 and vanes 47 together to form the impeller 45. The vanes 47 are of approximately 90° configuration, with a front wall 50 perpendicular to the center of the impeller 45, and a rear wall 51 extending from the front wall at a 90° angle, and out to the perimeter of plates 46, 44. The action of the pipe 32 and vanes 47 forms a venturi effect and results in enhanced operation.

The plates 46, 44 and vanes 47 can be formed of any corrosion resistant material with aluminum being particularly suitable. The lower plate 46 at its center has a shaft 52 extending downwardly therefrom with an upper rim 53, and a threaded portion 54, with a nut 55 retaining shaft 52 to plate 46.

The nut 55 can be of metal, or plastic such as nylon, and acts as a bearing against plate 20, to permit the rotation of impeller 45. The shaft 52 extends through a hole 60 in plate 20 which has a bearing 61 therein. The shaft 52 has a gear 62 thereon of approximately ¾ inch diameter, which can be retained by a cotter pin 63, which extends through a hole 64 in shaft 52, and holes 65 in gear extension 66 of gear 62. The gear 62 has teeth 67, which are engaged with teeth 68 of a larger gear 70, which is journaled on shaft 71, and is fastened to plate 20 by a screw 72 extending therethrough and into shaft 71. The shaft 71 has an upper bearing portion 73 against which extension 74 of gear 70 bears, and the gear 70 is retained on shaft 71 by a C clip 75 in groove 76 of shaft 71.

Figure 5A:
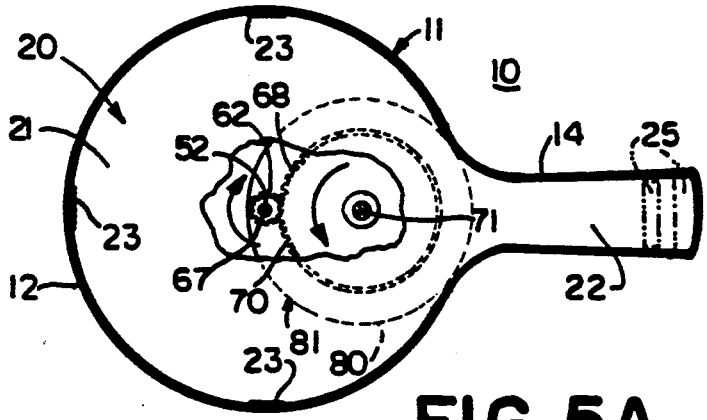
FIG. 5A is a fragmentary top plan view partially broken away, and in phantom, illustrating one embodiment of brush assembly used with the cleaner of the invention.

The gear 70 is of approximately three and one half inches in diameter and the gear ratio between gears 62 and 70 is a 6:1 reduction. The gears 62 and 70 are preferably of molded synthetic plastic such as nylon. A disc 80 of brush assembly 81 is secured to gear 70 by screws 82, which disc is of larger diameter than gear 70, and has a plurality of bristles 83 for scrubbing the pool surface S and propelling the cleaner 10 across the surface. As shown in FIG. 5A the brush assembly 81 is centered on gear 70.

Figure 5B:
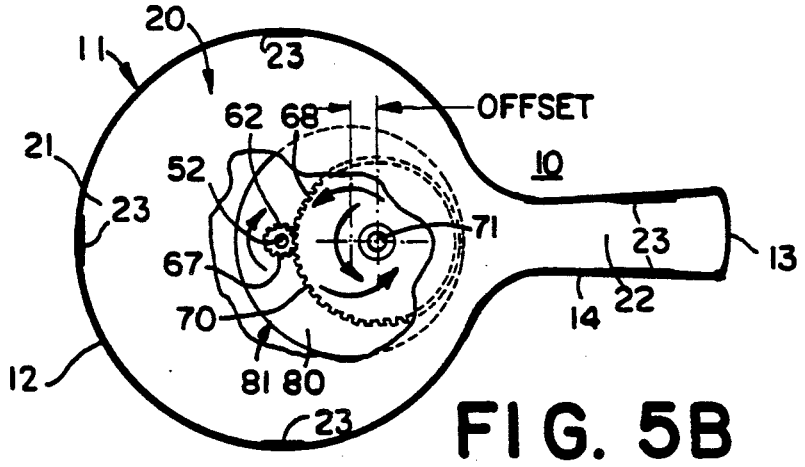
FIG. 5B is a view similar to FIG. 5A, illustrating another embodiment of brush assembly used with the cleaner of the invention.

Referring now to FIG. 5B the pool cleaner 10 is as described for FIGS. 1–5A and 6 but the disc 80 has been offset by resetting it a distance of approximately one inch, towards the front of plate 20, on gear 70 which in operation imparts an orpital motion to the cleaner 10, which may result in better motivation and make it less likely to become trapped in the corner of a pool (not shown).

Figure 5C:
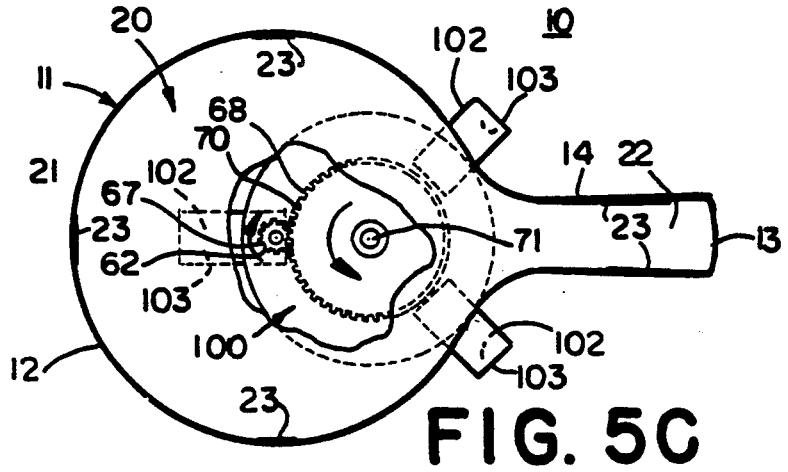
FIG. 5C is a view similar to FIG. 5A, illustrating still another embodiment of brush assembly used with the cleaner of the invention.
Figure 6:
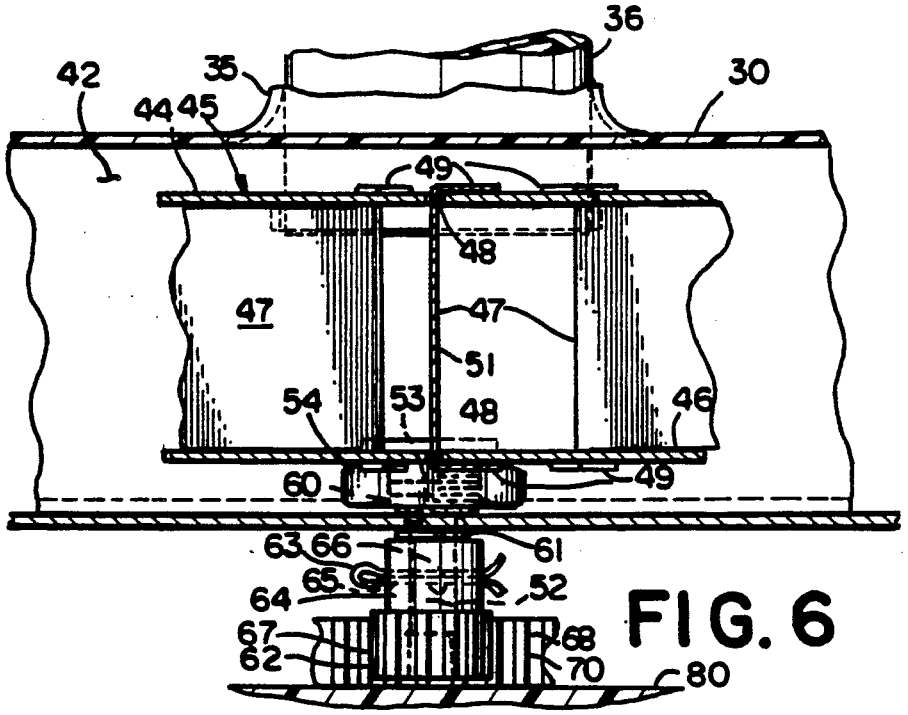
FIG. 6 is a vertical sectional view, enlarged, taken approximately on the Line 6—6 of FIG. 4.

Referring now to FIG. 5C a pool cleaner 10 is illustrated with an alternate brush assembly 100; which includes a disc 101 fastened to gear 70 as described above and with rectangular shaped brushes 102, fastened thereto at spaced locations, three being illustrated, but which can be of a greater number if desired. The brushes 102 have bristles 103 thereon, and in operation can assist the cleaner from possible entrappment in a pool corner (not shown).

The mode of operation will now be pointed out.

In operation the hose H is attached to fitting 41 the cleaner 10 placed in the pool P and the vacuum source VS activated. Water is drawn in through water inlet 13 in the tail 14 or slots 25 in plate 20, to and through pipe 32 into interior 42 of housing 30, and against vanes 47 of impeller 45, and therefrom out pipe 36 to hose H and thence towards to vacuum source VS.

The action of the water from pipe 32 against vanes 47 causes the impeller 45, to rotate and through shaft 52, and gears 62 and 70, rotate brush assembly 81 or 100, causing the bristles 83 or 103 to contact the pool surface S, scrub the dirt and debris therefrom so that it may be sucked into inlet 13 or slots 25, and then exit to the pool recirculation system as described.

The operation of the brush assembly 81 or 100, which is in frictional engagement with the pool surface, also causes the cleaner 10 to be moved across the pool surface S in a random pattern until it strikes a side of the pool, where it will push off and continue as described.

It will thus be seen that a swimming pool cleaner has been described with which the objects of the invention are attained.

I claim:

1. A cleaner for removing dirt and debris from the bottom surface of a swimming pool and the like, which pool has a vacuum source for removing water from the pool, to be treated in the pool recirculation system, and returned to the pool which comprises a base plate, a hollow outer cover fastened to and encapsulating said plate to form an interior space, a water outlet pipe connected to said outer cover and to a hose which extends to said vacuum source, a vacuum operated motor on said plate connected to and in communication with said pipe, at least one opening in said cover to permit water to flow into said cover upon vacuum application, said motor having an outer housing with a generally circular contour, said vacuum operated motor includes a water inlet means and an impeller, said impeller includes upper and lower plates with a plurality of vanes therebetween, said vanes are of L-shaped configuration with front walls perpendicular to the center of the impeller and rear walls at a 90° angle thereto, said water inlet means has a centerline which is tangential to the contour of said housing, and forms a venturi with said vanes, said water inlet means permitting water to flow into said motor causing said motor to operate, and said water then exits through said water outlet pipe, gears means connected to said motor, and brush means connected to said gear means to propell said cleaner in a random manner across said pool surface, and to lift dirt and debris from said surface to cause it to be suspended in said water and to be drawn in through said opening into said cover, through said motor and out said outlet pipe.

2. A cleaner as described in claim 1 in which said brush means is offset from the center line of its gear.

3. A cleaner as described in claim 1 in which said plate is recessed up within said cover to encapsulate dirt and debris to be removed.

* * * * *.